US005355053A

United States Patent [19]

Zhu

[11] Patent Number: 5,355,053

[45] Date of Patent: Oct. 11, 1994

[54] HIGH PRESSURE SODIUM LAMP STARTING AID

[75] Inventor: Huiling Zhu, Manchester, N.H.

[73] Assignee: OSRAM Sylvania Inc., Danvers, Mass.

[21] Appl. No.: 980,897

[22] Filed: Nov. 24, 1992

[51] Int. Cl.[5] ..... H01J 7/44; H01J 13/46

[52] U.S. Cl. ..... 315/73; 337/372; 337/380; 315/74; 315/330

[58] Field of Search ..... 315/73, 74, 72, 330; 337/298, 333, 362, 369, 372, 373, 380

[56] References Cited

U.S. PATENT DOCUMENTS

| | | | |
|---|---|---|---|
| 3,386,066 | 5/1968 | Audette | 337/373 |
| 3,718,162 | 2/1973 | Dafler et al. | 337/372 |
| 4,001,634 | 1/1977 | Corbley et al. | 315/73 |
| 4,037,129 | 7/1977 | Zack et al. | 315/73 |
| 4,521,760 | 6/1985 | Carbone | 337/372 |
| 4,780,649 | 10/1988 | Scholz et al. | 315/330 |
| 5,079,479 | 1/1992 | Weske et al. | 313/594 |

FOREIGN PATENT DOCUMENTS

0474277A1 3/1992 European Pat. Off. .

*Primary Examiner*—Robert J. Pascal
*Assistant Examiner*—Michael B. Shingleton
*Attorney, Agent, or Firm*—William H. McNeill; Joseph S. Romanow

[57] ABSTRACT

A starting aid for high pressure sodium vapor lamps eliminates the need to mechanically connect an ignition wire to the lamp frame. The starting aid employs an ignition wire which is slidably clipped directly to the arc tube at one end and which is connected to a bi-metallic switch at the other end. The bi-metallic switch is mechanically and electrically connected to one power lead of the arc tube.

1 Claim, 5 Drawing Sheets

HIGH PRESSURE SODIUM LAMP STARTING AID

FIELD OF THE INVENTION

The present invention relates generally to starting aids for high pressure arc lamps and, more particularly, to ignition wires used in high pressure sodium (HPS) arc lamps.

BACKGROUND OF THE INVENTION

Many designs for HPS arc lamps are currently known in the art. These lamps typically have a polycrystalline alumina (PCA) arc tube filled with a mixture of gases, including xenon, and one or more amalgams of sodium and mercury which form an arc discharge.

The sodium and mercury components of the fill material are primarily responsible for the light output characteristics of the lamp. For example, the ratio of the mixture affects the color spectrum of the light output. The xenon component of the gas mixture primarily helps to improve lamp life and efficiency. However, HPS lamps including xenon at a relatively high pressure in the gas mixture are difficult to start reliably without an external starting aid.

External starting aids generally take the form of an elongated conductive element, such as a metal ignition wire, or a coiled ignition filament. The starting aid is positioned in contact with an outer surface of the PCA arc tube. The starting aid is connected to one electrical power lead of the lamp. When an arc is formed and the lamp begins to warm up, either power is removed from the starting aid, or the starting aid is moved away from the arc tube, so as to prevent electric field accelerated sodium diffusion through the arc tube wall. Such sodium diffusion would adversely affect lamp life.

In one prior art design, when the temperature of the lamp rises to a certain value, the starting aid is disconnected from the electrical power lead, for example by means of a bi-metallic switch electrically connected between the starting aid and the electrical power lead.

Another HPS lamp of the prior art includes a metal frame, from which the starting aid is stretched across a surface of the arc tube. The metal frame is connected to one power lead of the lamp. Bi-metallic strips attached to the frame lift the starting aid from the surface of the arc tube when the lamp approaches operating temperature.

There are a number of problems inherent in prior art starting aid designs. The ignition wire or coiled ignition filament of the prior art is suspended from the lamp frame. This involves a difficult and costly welding operation. Furthermore, in the absence of direct attachment of the ignition wire or coiled ignition filament to the arc tube, the wire or filament may sag away from the arc tube due to the high temperature of operation of these lamps. Additionally, the bi-metallic switches of the prior art are typically attached to the lamp frame. Thus, they are heated by radiation, rather than by conduction, which makes the performance of a switch design vary when it is used in lamps of different wattage. Finally, the prior art attachment of starting aids to the lamp frame and the prior art bi-metallic switch designs result in a complex and costly assembly process.

SUMMARY OF THE INVENTION

The present invention provides a new starting aid for HPS lamps, which requires no external frame for support of the starting aid. The starting aid is simpler and easier to assemble than prior art switches.

The starting aid of the present invention includes an ignition element having an upper end held in slidable engagement with the arc tube of an HPS lamp by means of a clip formed at that end. The lower end of the ignition element of the present invention terminates at a bi-metallic switch, which connects the ignition element to one terminal of a power source when the lamp is below a predetermined temperature and disconnects the ignition element from the power source when the lamp is at or above the predetermined temperature. The bi-metallic switch of the present invention is connected to the power source so as to be heated primarily by thermal conduction from the arc tube rather than by radiation.

The bi-metallic switch of the present invention may be formed of two U-shaped conductive elements. One U-shaped element may be a bi-metallic strip, while the other U-shaped element may be a U-shaped wire. One arm of the bi-metallic strip may be electrically connected to the U-shaped wire, while the other arm of the bi-metallic strip may be electrically isolated from the U-shaped wire by an insulating support means. The insulating support means supports the lower end of the ignition wire.

BRIEF DESCRIPTION OF THE DRAWINGS

For a better understanding of the present invention, reference is made to the accompanying drawings wherein like reference designations indicate like elements, incorporated herein by reference, and in which.

Figure 1:
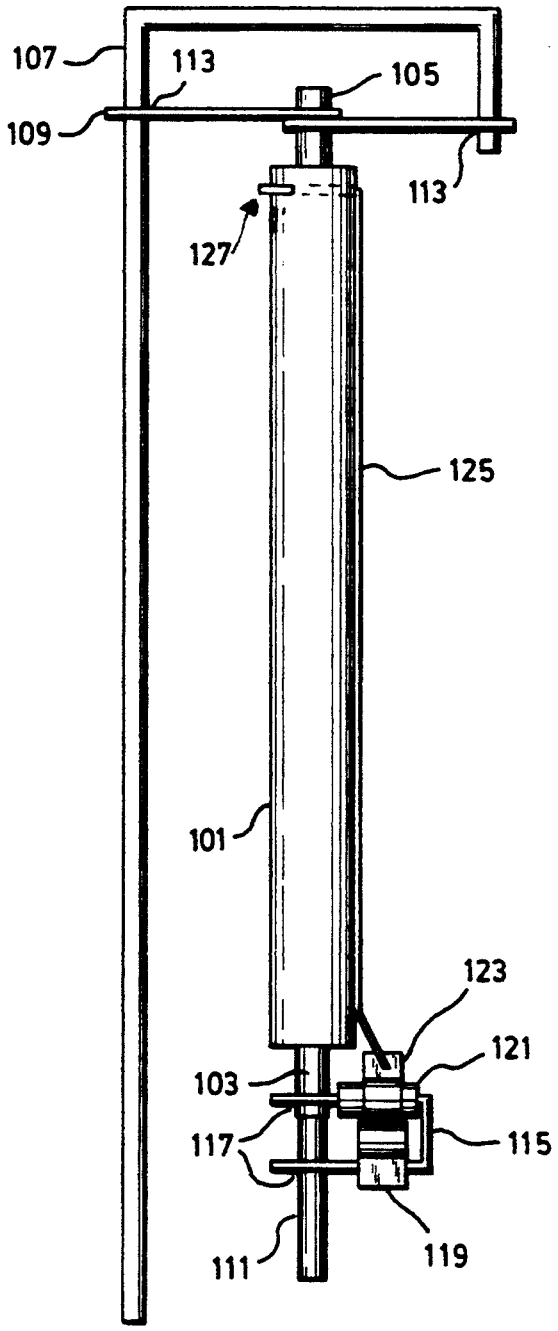
FIG. 1 is a front view of the interior structure of an HPS lamp according to the present invention.
Figure 3:
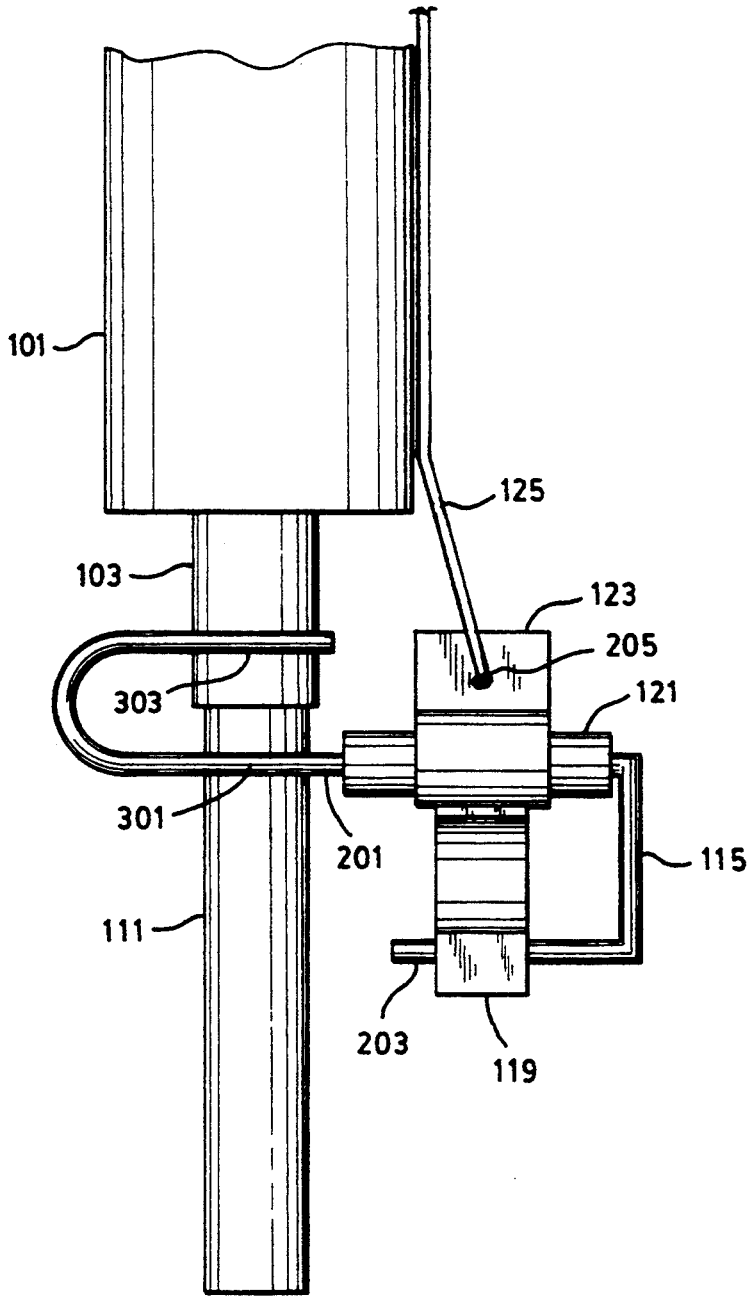
Figure 4:
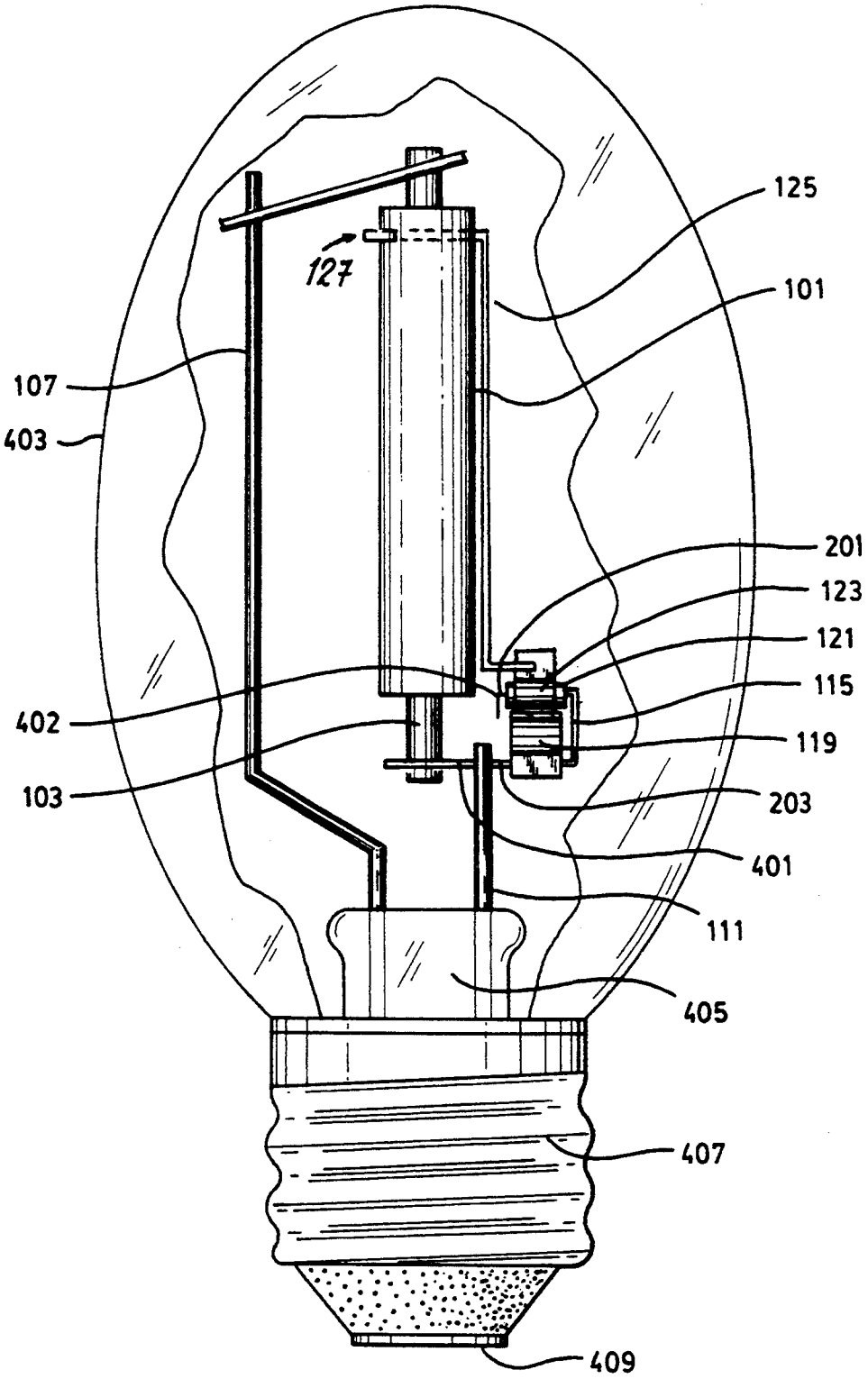
Figure 5:
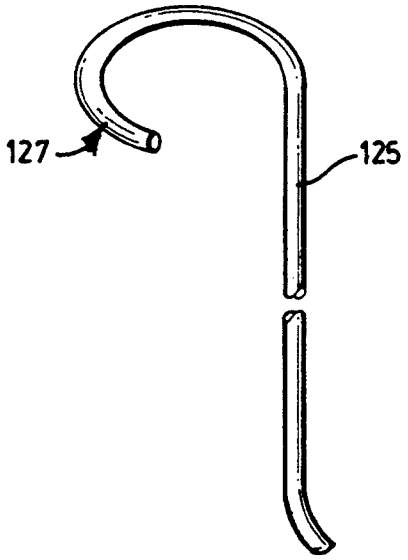

FIGS. *2a* and *2b* are front and side views, respectively, of the bi-metallic switch elements of the lamp of FIG. 1;

FIG. 3 is a front view of a detail of another embodiment of a lamp according to the present invention;

FIG. 4 is a front view of another embodiment of a lamp according to the present invention;

FIG. 5 is a perspective view of one embodiment of an ignition wire; and

Figure 6:
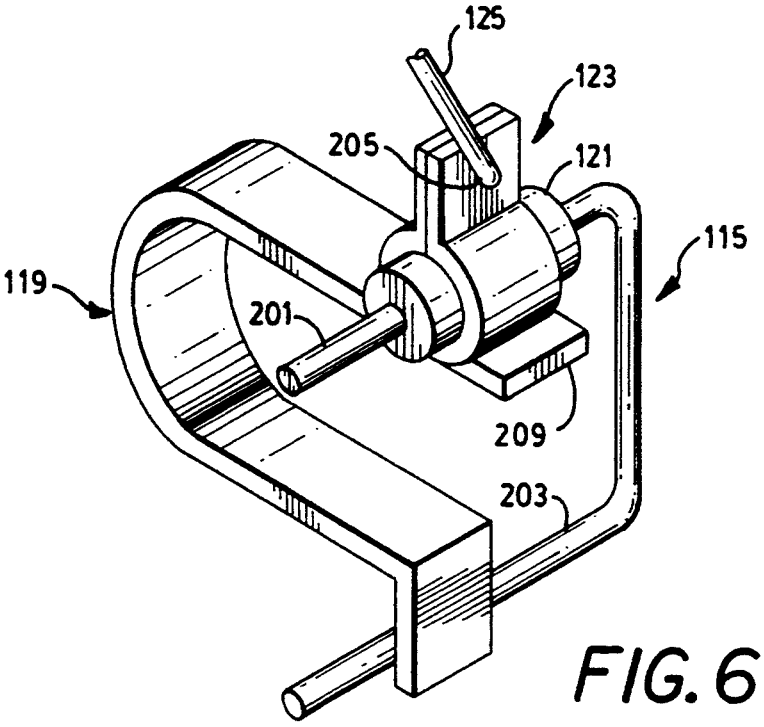

FIG. 6 is a perspective view of one embodiment of a thermal switch in accordance with the invention.

DETAILED DESCRIPTION

FIG. 1 shows the interior structure of one embodiment of an HPS lamp constructed according to the present invention. The light-producing element of such a lamp is an arc tube 101, typically fabricated of PCA and containing a conventional fill material. Power is conducted to electrodes (not shown) within arc tube 101 by niobium feedthroughs 103 and 105.

Mechanical support for arc tube 101 and electrical power for niobium leads 103 and 105 are provided by a frame 107, a loop wire 109 and a supporting rod 111. At an upper end of arc tube 101, loop wire 109 is wrapped around niobium feedthrough 105, thereby making both an electrical and mechanical connection thereto. Loop wire 109 is also electrically and mechanically connected to frame 107 at points 113, for example by welding. Power is thus conducted from a power source to loop wire 109 by frame 107. At a lower end of arc tube 101, niobium feedthrough 103 rests against supporting rod 111, thus receiving mechanical support. An electrical connection and further mechanical stability is provided by a U-shaped niobium wire 115 welded to niobium lead 103 and supporting rod 111 at points 117.

In addition to providing a mechanical and an electrical connection between support rod 111 and niobium feedthrough 103, U-shaped niobium wire 115 is part of a starting aid for the HPS lamp. Additional components of the starting aid of this embodiment include a U-shaped bi-metallic strip 119, an insulating tube 121 of $Al_2O_3$, a metal strap 123 wrapped around insulation tube 121, and a tungsten ignition wire 125. Tungsten ignition wire 125 is slidably attached to arc tube 101 near the upper end of arc tube 101. In this embodiment, the slidable attachment is made by forming the distal end of tungsten ignition wire 125 into a C-shaped clip 127. If the arc of the C-shaped clip 127 includes about 3/5-¾ of a circle having approximately the same diameter as the outside diameter of PCA arc tube 101, for example, then C-shaped clip 127 can be readily snapped onto arc tube 101 after arc tube 101 is securely assembled into frame 107.

Figure 2A:
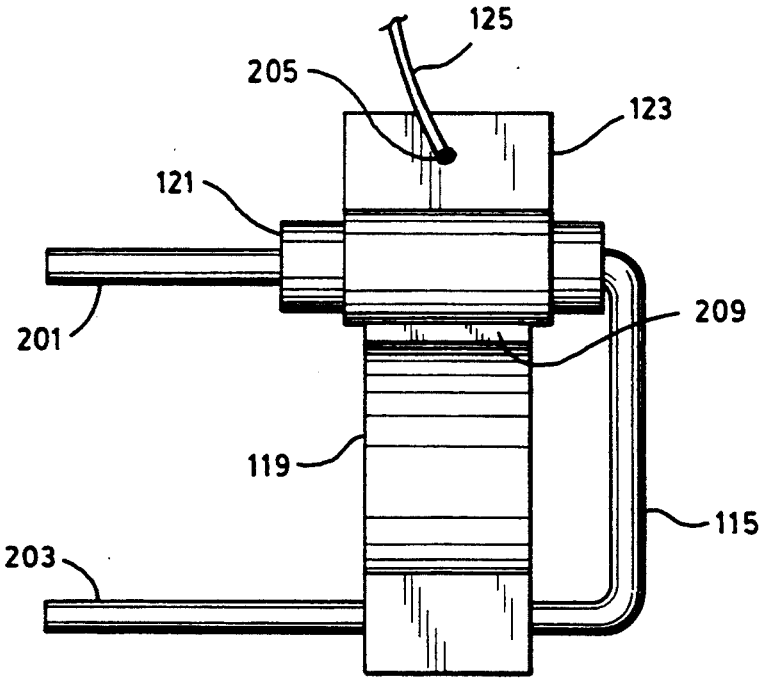
Figure 2B:
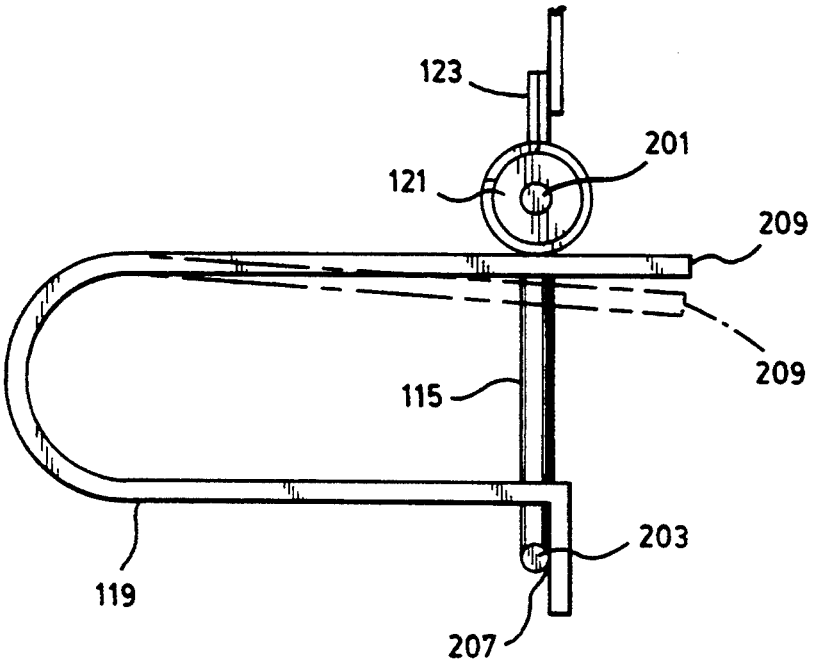

The starting aid of the embodiment of FIG. 1 is now described in greater detail with reference to FIGS. 2*a* and 2*b*. In FIG. 2*a*, U-shaped niobium wire 115 is shown with an upper arm 201 and a lower arm 203 extending to one side, while in FIG. 2*b* the arms 201 and 203 extend out of the page. Arms 201 and 203 are welded at points 117, as shown in FIG. 1. Arm 201 carries $Al_2O_3$ insulating tube 121. Thus, metal strap 123 may be mechanically fastened to U-shaped niobium wire 115 without forming an electrical connection thereto, by wrapping the metal strap 123 tightly about insulating tube 121.

Metal strap 123, in turn, provides mechanical support for tungsten ignition wire 125 at weld 205. Furthermore, metal strap 123 provides an electrical connection between U-shaped niobium wire 115 and tungsten ignition wire 125, through a U-shaped bi-metallic strip 119. As shown in FIG. 2*b*, U-shaped bi-metallic strip 119 is welded to U-shaped niobium wire 115 at point 207. End 209 of U-shaped bi-metallic strip 119 is free to move as temperature changes cause the shape of U-shaped bi-metallic strip 119 to vary. In particular, U-shaped bi-metallic strip is arranged such that when U-shaped bi-metallic strip 119 is heated to a predetermined temperature, contact between U-shaped bi-metallic strip 119 and metal strap 123 is broken, because of the motion of end 209 of bi-metallic strip 119 (as shown in phantom in FIG. 2*b*). The bi-metallic strip 119 thus functions as a bi-metallic switch which is open at or above the predetermined temperature and which is closed below the predetermined temperature.

Referring again to FIG. 1, operation of the starting aid is now described. Before power is applied to the lamp, the bi-metallic switch is closed and bi-metallic strip 119 is in contact with metal strap 123. When power is applied to the lamp, the tungsten ignition wire 125 is energized through the bi-metallic strip 119. After an arc forms and the lamp heats up, the bi-metallic switch opens (contact between bi-metallic strip 119 and metal strap 123 is broken), thus de-energizing the tungsten ignition wire 125. This operation of the bi-metallic switch occurs as heat is conducted from the arc tube 101 along niobium feedthrough 103 and U-shaped niobium wire 115, thus raising the temperature of U-shaped bi-metallic strip 119. The predetermined temperature at which contact between bi-metallic strip 119 and metal strap 123 is broken is selected to be that temperature at which the lamp has achieved a stable arc, not requiring continued use of a starting aid. Thus, the heat conducted to U-shaped bi-metallic strip 119 causes power to be disconnected from tungsten ignition wire 125 when it is no longer needed. Therefore, sodium diffusion through PCA arc tube 101 is not electrically accelerated by tungsten ignition wire 125 for a period longer than is necessary to start the lamp.

A second embodiment of the invention is shown in FIG. 3. This embodiment is particularly suitable for lamps which operate at such high temperatures that it may be difficult to design the bi-metallic strip 119 to function as described above. In this embodiment, the arrangement of the tungsten ignition wire 125, the metal strap 123, the $Al_2O_3$ tube 121 and the U-shaped niobium wire 115 with respect to each other is substantially the same as described above. A difference between this embodiment and the embodiment of FIGS. 1, 2*a* and 2*b* lies in the attachment of the U-shaped niobium wire 115 to the supporting rod 111 and the niobium lead 103.

Specifically, arm 201 is extended to form a second U-shaped loop, having a lower arm 301 connected to supporting rod 111 and an upper arm 303 connected to niobium feedthrough 103. Thus, the extension of arm 201, including arms 301 and 303 provides the electrical and mechanical connection between supporting rod 111 and niobium feedthrough 103 that is provided in the embodiment of FIGS. 1, 2*a* and 2*b* by arms 201 and 203. However, in this embodiment, U-shaped bi-metallic strip 119 is more thermally isolated from arc tube 101, because arm 201 is mechanically connected to supporting rod 111, which is more thermally isolated from arc tube 101 than niobium feedthrough tube 103.

Yet another embodiment is now described in connection with FIG. 4. This embodiment is substantially similar to the embodiment of FIG. 3. However, an extension 401 of arm 203 is straight, rather than U-shaped. In this embodiment, supporting rod 111 does not provide direct mechanical support for niobium feedthrough 103, but does so indirectly through the extension 401 of arm 203. Furthermore, arm 201 includes a bend 402 to ensure retention of insulating tube 121 on arm 203. In other respects, this embodiment is as described above with respect to FIG. 3.

The starting aid components are assembled to each other and operate in the manner described above with respect to FIGS. 1, 2*a* and 2*b*. When the lamp is cool, i.e. below the predetermined temperature, power is supplied to tungsten ignition wire 125 by support rod 111 through U-shaped niobium wire 115, U-shaped bi-metallic strip 119 and metal strap 123. When the lamp is at operational temperature, i.e. at or above the predetermined temperature, U-shaped bi-metallic strip 119 breaks contact with metal strap 123, thereby disconnecting power from tungsten ignition wire 125. Metal strap 123 is electrically isolated from U-shaped niobium wire 115 by insulating tube 121. A range of typical closure temperatures for bi-metallic strip 119 is about 200° C.–300° C. Bi-metallic strip 119 may be operated up to about 450° C., depending on the choice of materials.

FIG. 4 also shows the integration of the present invention into a complete HPS lamp. In this lamp, PCA arc tube 101 and the various starting aid elements are enclosed within an outer envelope 403. Frame 107 and supporting rod 111 are supported by a stem 405. Frame 107 and supporting rod 111 are electrically connected to lamp base contacts 407 and 409, respectively.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A starting aid for a high pressure arc discharge lamp having an arc tube with a power lead in each end of the arc tube, comprising:

a U-shaped wire connected to one of the power leads, said wire having upper and lower arms, said U-shaped wire including a section for mechanically connecting said one of the power leads to a support rod in the lamp, said section being a U-shaped extension of one arm of said U-shaped wire;

an insulating tube disposed about one arm of the U-shaped wire;

a conductive strap disposed about the insulating tube;

a U-shaped bimetallic strip, having one arm connected to the U-shaped wire and having the other arm in contact with the conductive strap when the bimetallic strip is below a predetermined temperature and having the other arm not in contact with the conductive strap when the bimetallic strip is at or above the predetermined temperature; and an ignition wire having two ends, one end connected to the conductive strap and the other end formed into a clip for holding the ignition wire in contact with an outer surface of the arc tube.

* * * * *